US006467896B2

(12) United States Patent
Meyer et al.

(10) Patent No.: US 6,467,896 B2
(45) Date of Patent: Oct. 22, 2002

(54) PRINTING SYSTEM FOR SELECTIVELY PRINTING WITH DYE-BASED INK AND/OR PIGMENT-BASED INK

(75) Inventors: John F. Meyer, San Diego, CA (US); Dennis Sonnenburg, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/784,418

(22) Filed: Feb. 13, 2001

(65) Prior Publication Data

US 2002/0109766 A1 Aug. 15, 2002

(51) Int. Cl.[7] ..... B41J 2/01
(52) U.S. Cl. ..... 347/101
(58) Field of Search ..... 347/6, 14, 15, 347/43, 101

(56) References Cited

U.S. PATENT DOCUMENTS 4,528,576 A * 7/1985 Koumura et al. ..... 347/15
5,764,263 A * 6/1998 Lin ..... 347/101
5,880,749 A * 3/1999 Kikkawa et al. ..... 347/9
6,132,021 A 10/2000 Smith et al. ..... 347/6
6,164,771 A 12/2000 Eckard et al. ..... 347/86
6,234,601 B1 * 5/2001 Hayashi et al. ..... 347/16

* cited by examiner

*Primary Examiner*—John Barlow
*Assistant Examiner*—Michael S Brooke

(57) ABSTRACT

A printing system for selectively printing with dye-based and/or pigment-based inks depending upon factors including, but not limited to, the type of media, the nature of the print job, and the level of print quality desired. The printing system includes a print head with two (or more) pigment-based black pens, a dye-based black pen, and a plurality of color pens. In a preferred embodiment, the pens are arranged in the following sequence: KABCMY, K being a dye-based black ink dispenser, A and B being pigment-based black ink dispensers, C being a dye-based cyan ink dispenser, M being a dye-based magenta ink dispenser, and Y being a dye-based yellow ink dispenser. This print head arrangement allows the selective printing with dye-based and/or pigment-based inks functionality to be implemented for different types of print media without having to replace print heads and/or cartridges of the printing system. This print head arrangement also accommodates bi-directional printing and under/overprinting printer system features.

18 Claims, 7 Drawing Sheets

PRINTING SYSTEM FOR SELECTIVELY PRINTING WITH DYE-BASED INK AND/OR PIGMENT-BASED INK

BACKGROUND OF THE INVENTION

1. Field of Invention

The present invention relates generally to a printing system for selectively printing with dye-based ink and/or pigment-based ink and, more specifically, to a print head for such a printing system, the print head including two (or more) pigment-based black pens, a dye-based black pen, and a plurality of color pens.

2. Description of the Related Art

Print heads in color inkjet printers are typically arranged with their pens in the sequence, KCMY, where: K=pigmented black, C=cyan, M=magenta, and Y=yellow. Recently, print heads have been developed to accommodate other arrangements such as photo printing with six inks, for example, the pen arrangement, KCcl YMml, where: cl=light cyan and ml=light magenta.

Other print head arrangements have been employed for dry time purposes. In U.S. Pat. No. 6,132,021 to Smith et al. (incorporated herein by reference), the pen arrangement, CKMY, allows over and under printing of cyan and magenta in order to improve the dry time of the pigmented black ink while printing in a bi-directional manner. However, this arrangement can allow hue shift on the black when printed in a bi-directional manner due to the use of cyan as under printing and magenta as overprinting in one direction, and magenta as under printing and cyan as overprinting in the other printing direction (FIG. 6A).

For the purposes of this disclosure, "Type A" media is any paper or coated media that can accept pigmented inks, e.g., HP Premium Matte Brochure Paper. "Type B" media is any photo media that does not accept pigmented inks, e.g., HP Premium Photographic Plus.

Although various print head arrangements exist, there is a need for a printer system which includes all inks on its carriage needed to function as both a high-speed office printer and as a high-quality photographic printer without user intervention (i.e., without manually changing the print heads and cartridges). Also, it would be desirable for such a printer system to selectively energize dye-based and/or pigment-based ink pens on its carriage depending upon the type of media being printed on.

SUMMARY OF THE INVENTION

The printing system of the present invention is configured to selectively print with dye-based and/or pigment-based inks to accommodate different types of media. The printing system includes a print head arrangement with both dye-based and pigment-based inks on the carriage. For example, a print head arrangement according to the present invention includes two (or more) pigment-based black pens, a dye-based black pen, and a plurality of color pens. The dye-based black ink is a composite black (approximately equal parts of cyan, magenta and yellow) or a "true" dye-based black ink which allows for more efficient use of ink. With less ink on the media, dry time is reduced, the possibility of printing flaws such as coalescence (where the ink exceeds the ability of the media to "process" the ink quantity and the ink droplets tend to clump or coalesce together) is reduced, and photo quality is improved by providing a darker black.

In accordance with one embodiment of the present invention, a printing system for selectively printing with different types of ink includes: a plurality of ink dispensers including two or more pigment-based black ink dispensers and a dye-based black ink dispenser; and a controller configured to generate ink dispenser control signals to selectively energize the ink dispensers. In a preferred embodiment, the controller is configured to generate the ink dispenser control signals to selectively energize the pigment-based black ink dispensers and the dye-based black ink dispenser depending upon the type of media being printed on. In a preferred embodiment, the plurality of ink dispensers include six ink dispensers arranged in a sequence, KABCMY, K being the dye-based black ink dispenser, A and B being the pigment-based black ink dispensers, C being a dye-based cyan ink dispenser, M being a dye-based magenta ink dispenser, and Y being a dye-based yellow ink dispenser. In a preferred embodiment, the controller is configured to generate the ink dispenser control signals to energize the dye-based black ink dispenser (K), the pigment-based black ink dispensers (A, B), the dye-based cyan ink dispenser (C), the dye-based magenta ink dispenser (M) and/or the dye-based yellow ink dispenser (Y) to print text, graphics and/or an image. In a preferred embodiment, the controller is configured to generate the ink dispenser control signals to alternately energize the pigment-based black ink dispensers (A, B). In a preferred embodiment, the controller is configured to generate the ink dispenser control signals to energize the dye-based black ink dispenser (K) to under print. In a preferred embodiment, the controller is configured to generate the ink dispenser control signals to energize the dye-based cyan ink dispenser (C) and the dye-based magenta ink dispenser (M) to under print. In a preferred embodiment, the controller is configured to generate the ink dispenser control signals to energize the dye-based black ink dispenser (K) to under print and the dye-based cyan ink dispenser (C) and the dye-based magenta ink dispenser (M) to overprint, or vice versa.

In accordance with another embodiment of the present invention, a printing system for selectively printing with different types of ink includes: a plurality of ink dispensers including a dye-based black ink dispenser (K), two pigment-based black ink dispensers (A, B) and a plurality of colored ink dispensers; and a controller configured to generate ink dispenser control signals which energize the ink dispensers, the ink dispenser control signals being generated to selectively energize the dye-based black ink dispenser (K) and the pigment-based black ink dispensers (A, B) depending upon the type of media being printed on. In a preferred embodiment, the pigment-based black ink dispensers (A, B) are positioned adjacent to each other. In a preferred embodiment, the plurality of colored ink dispensers include a cyan ink dispenser (C) and a magenta ink dispenser (M), and the plurality of ink dispensers are arranged linearly such that the dye-based black ink dispenser (K) is positioned on one side of the pigment-based black ink dispensers (A, B), and the cyan ink dispenser (C) and the magenta ink dispenser (M) are positioned on another side of the pigment-based black ink dispensers (A, B). In a preferred embodiment, the controller is configured to generate the ink dispenser control signals to energize the dye-based black ink dispenser (K), the pigment-based black ink dispensers (A, B) and/or the colored ink dispensers to print text, graphics and/or an image. In a preferred embodiment, the controller is configured to generate the ink dispenser control signals to alternately energize the pigment-based black ink dispensers (A, B). In a preferred embodiment, the controller is configured to generate the ink dispenser control signals to energize the dye-based black ink dispenser (K) to under print. In a preferred embodiment, the controller is configured to generate the ink dispenser control signals to energize the dye-based cyan ink dispenser (C) and the dye-based magenta ink dispenser (M) to under print. In a preferred embodiment, the controller is configured to generate the ink dispenser control signals to energize the dye-based black ink dispenser (K) to under print and the dye-based cyan ink dispenser (C) and the dye-based magenta ink dispenser (M) to overprint, or vice versa.

In accordance with another embodiment of the present invention, a printing system for selectively printing with different types of ink includes: a plurality of ink dispensers including dye-based and pigment-based ink dispensers; and a controller configured to generate ink dispenser control signals which energize the ink dispensers, the ink dispenser control signals being generated to selectively energize the dye-based and pigment-based ink dispensers depending upon the type of media, being printed on without user intervention to replace print heads and/or cartridges of the printing system.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

DETAILED DESCRIPTION OF THE PREFERRED EMBODIMENTS

The following is a detailed description of the best presently known mode of carrying out the invention. This description is not to be taken in a limiting sense, but is made merely for the purpose of illustrating the general principles of the invention.

While the following detailed description relates to printers, it should be understood that the principles set forth herein apply to printing devices in general, such as copiers, fax machines, scanners and combinations thereof.

Figure 1:
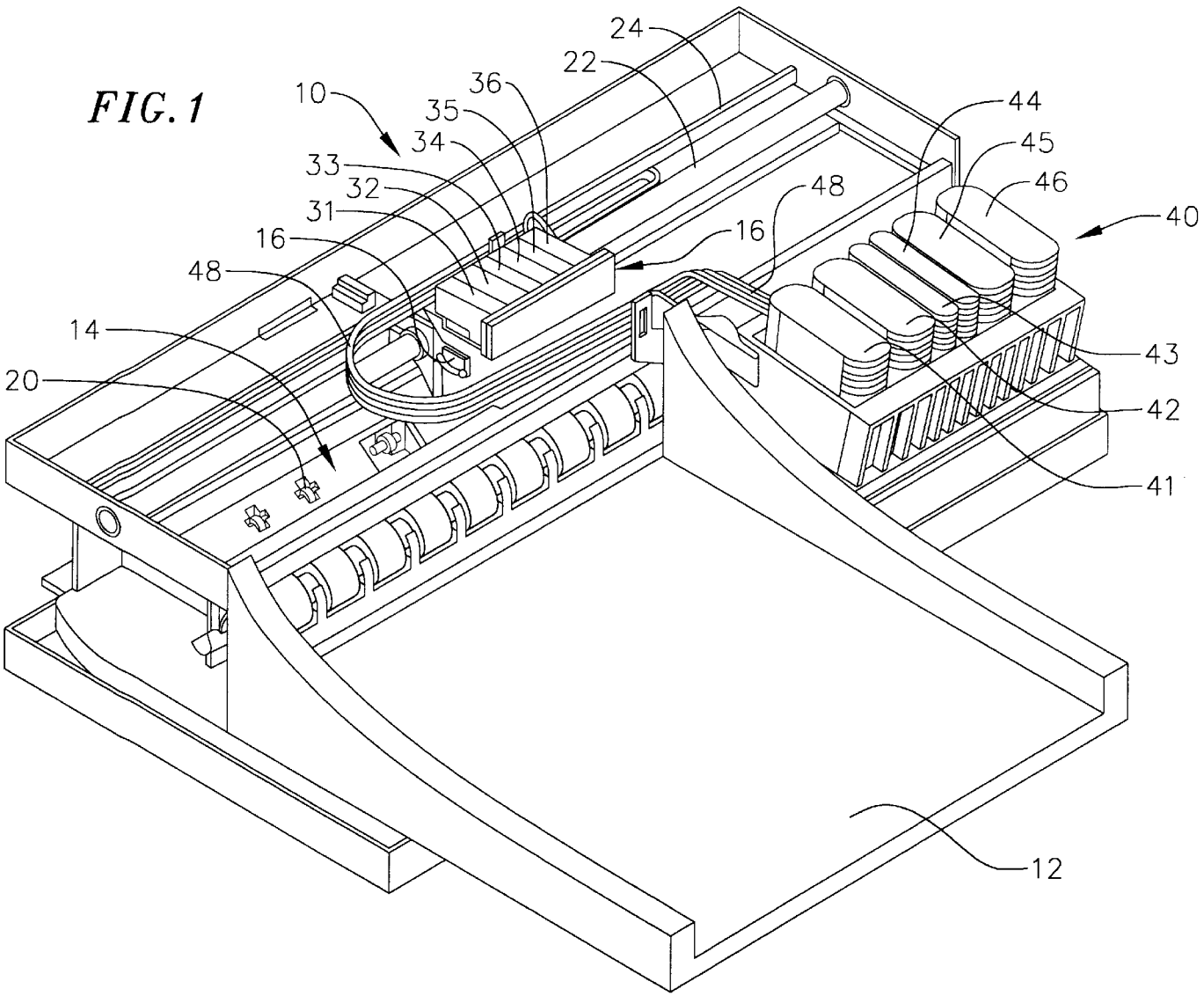
FIG. 1 is a perspective view of one of many examples of a printer that incorporates the principles of the present invention.

Referring to FIG. 1, an exemplary inkjet printer 10 embodying the principles of the present invention is shown. The inkjet printer 10 (shown with its cover removed) includes an input tray 12 for holding media. It should be understood that the principles of the present invention are applicable to printers which accommodate A-size (8½×11 inches) media, B-size (11×17 inches) media, or any other size of media. In operation, an item of print media is advanced through a print zone 14 of the printer 10 by a conventional stepper motor and feed rollers 20, and a scanning carriage assembly 16 (containing one or more print cartridges) is scanned across the item of media for printing ink thereon. An exemplary mechanism for scanning the carriage assembly 16 includes a slide rod 22, along which the carriage assembly 16 slides, and a coded strip 24 which is optically detected by a photo detector (e.g., in the carriage assembly 16) for precisely positioning the carriage assembly 16. In the illustrated embodiment, the carriage assembly 16 is moved across the print zone 14 by a stepper motor (not shown) using a conventional drive belt and pulley arrangement. In an alternative embodiment, the printer is configured such that the carriage assembly 16 is stationary and the item of media is moved relative to the carriage assembly 16 during printing.

Figure 2:
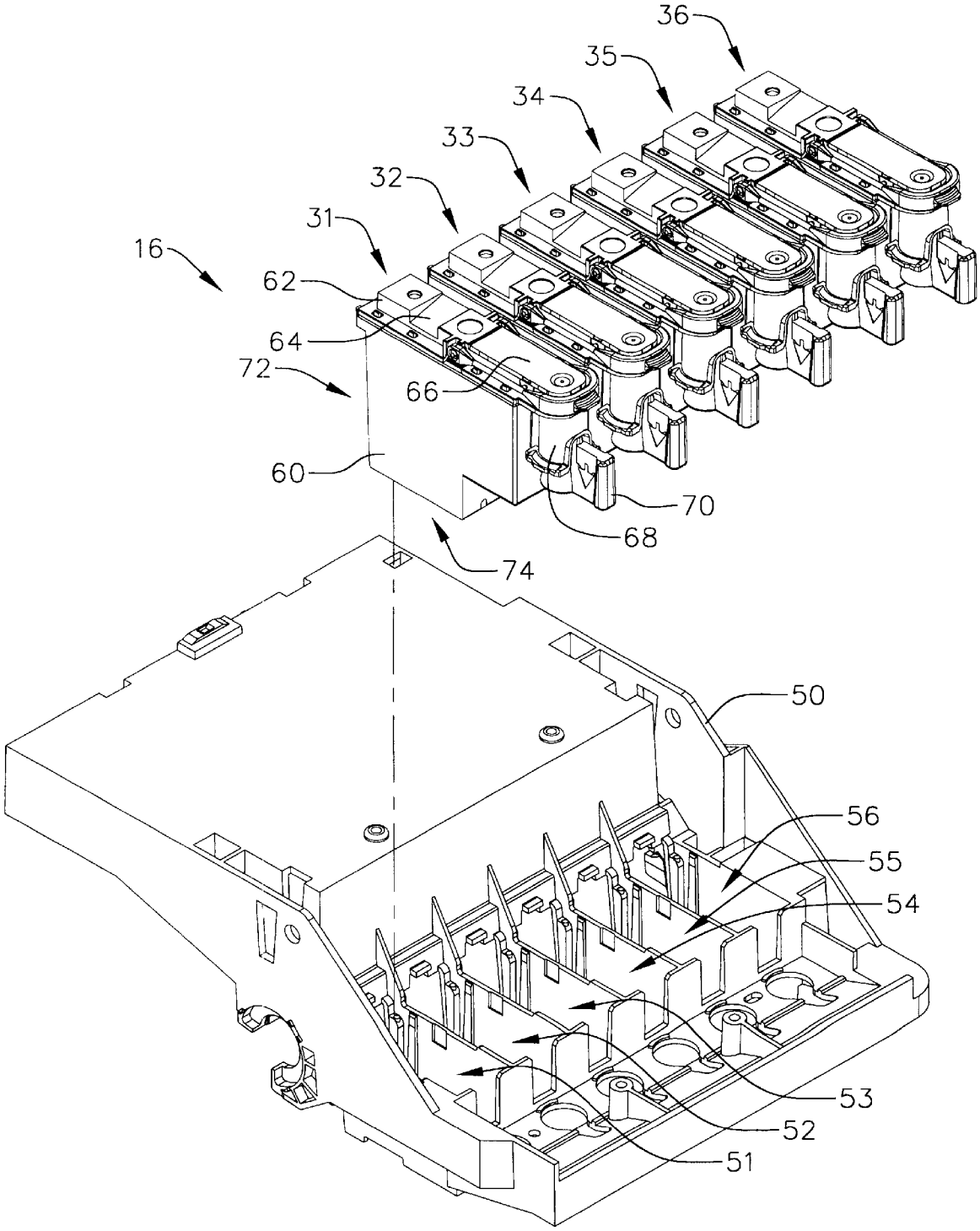
FIG. 2 is an exploded perspective view of an exemplary preferred carriage assembly (shown without its latching mechanism) according to the present invention.
Figure 3:
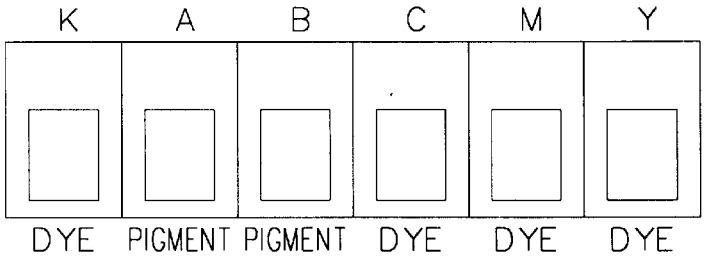
FIG. 3 illustrates an exemplary preferred print head arrangement according to the present invention.

Generally, the carriage assembly 16 of the present invention comprises two (or more) pigment-based black pens, a dye-based black pen, and a plurality of color pens. The illustrated exemplary preferred carriage assembly 16 includes six ink dispensers (e.g., print cartridges) 31, 32, 33, 34, 35 and 36 which, respectively, print dye-based black (K), a first pigment-based black (A), a second pigment-based black (B), cyan (C), magenta (M), and yellow (Y). As discussed above, the K ink is a "true black" dye-based ink. The two black ink dispensers accommodate the (slower drying) pigment-based black ink and are preferably positioned adjacent to each other. In an alternative embodiment, only one dispenser is provided for pigment-based black ink. The CMY inks are preferably dye-based, but can also be pigment-based. Referring also to FIGS. 2 and 3, the print cartridges are preferably arranged in the sequence, KABCMY, to better facilitate the under/over printing features of the printer 10. To accommodate these features, the plurality of ink dispensers are preferably arranged such that: the dye-based black ink dispenser (K) is positioned on one side of the pigment-based black ink dispensers (A, B); and the cyan ink dispenser (C), the magenta ink dispenser (M) and the yellow ink dispenser (Y) are positioned on another side of the pigment-based black ink dispensers (A, B). The order of the colored inks in the print head sequence can be changed to CYM, MYC, MCY, YMC or YCM, consistent with the above description.

Referring to FIG. 1, the printer 10 also includes an off-axis ink supply station 40 and a plurality of flexible tubes 48 which provide fluidic interconnections between the ink supply station 40 and the ink dispensers 31, 32, 33, 34, 35 and 36. In the illustrated embodiment, the ink supply station 40 includes replaceable ink supply cartridges 41, 42, 43, 44, 45, 46 which serve as containers and supplies for the K, A, B, C, M and Y inks, respectively. Preferably, each print cartridge is provided with its own ink supply and, therefore, the plurality of flexible tubes 48 comprises at least as many tubes as there are print cartridges and ink supplies. In the illustrated embodiment, the plurality of flexible tubes 48 comprises six or more tubes. Preferably, the ink supply station 40 is configured to accommodate ink supply cartridges varying in size depending upon the consumption rates of the different inks for a particular printing system or application. By way of example, each of the ink supply cartridges 41, 42, 45 and 46 has a 70 cc volumetric capacity and each of the ink supply cartridges 43, 44 has a 28 cc volumetric capacity. In a preferred embodiment, the black and yellow ink supply cartridges are larger-sized than the cyan and magenta ink supply cartridges. In a preferred embodiment, ink cartridges (e.g., larger-sized cartridges, black ink cartridges) can be serviced by two or more of the flexible tubes.

In another embodiment, the ink supplies are removeably mounted on the print heads in the carriage. In this embodiment, the ink supplies are replaceable and the print head is permanent (therefore, it is not necessary to incur the expense of replacing an entire pen/ink supply). In a preferred embodiment, the ink supplies are kept small to reduce the mass of the carriage which, in turn, reduces the motor/power requirements, allows for a lower ink supply profile, and reduces the number of parts needed.

Referring to FIG. 2, an exemplary preferred carriage chassis 50 is formed as shown with pen stalls 51, 52, 53, 54, 55 and 56. The pen stalls are preferably formed with X, Y and Z datums and springs or other mechanisms for biasing the pens (which are formed with complementary datums, etc.) to desired positions within the pen stalls. See, U.S. Pat. No. 6,164,771 to Eckard et al. (incorporated herein by reference). Further with respect to the ink dispensers, the pen 31 is representative and includes a pen body Further with respect to the pens, the exemplary ink dispenser 31 is representative and includes a pen body 60, a crown 62, a latch surface 64, a handle 66, a shroud 68, a needle plug 70, electrical interconnect (contact) pads 72 and a print head nozzle plate 74. The illustrated print cartridge 31 has an ink passage which directs ink from one of the off-axis ink supplies to a print head portion of the pen. The print head portion generally includes a print head substrate with ink channels leading to chambers surrounding ink ejection elements. The nozzle plate is positioned over the substrate with each nozzle overlying an ink ejection chamber. In one embodiment, nozzles are formed in a flexible tape (a TAB circuit). The contact pads supply electrical signals to the print head substrate via traces on the TAB circuit. In another embodiment, the nozzle plate comprises an epoxy or metal. The print head may use resistive, piezoelectric or other types of ink ejection elements. The shroud 68 covers and protects a needle (not shown) which provides a supply of ink to the pen and serves to interface the needle with its septum. See again, U.S. Pat. No. 6,164,771 which describes a similar pen.

Figure 4:
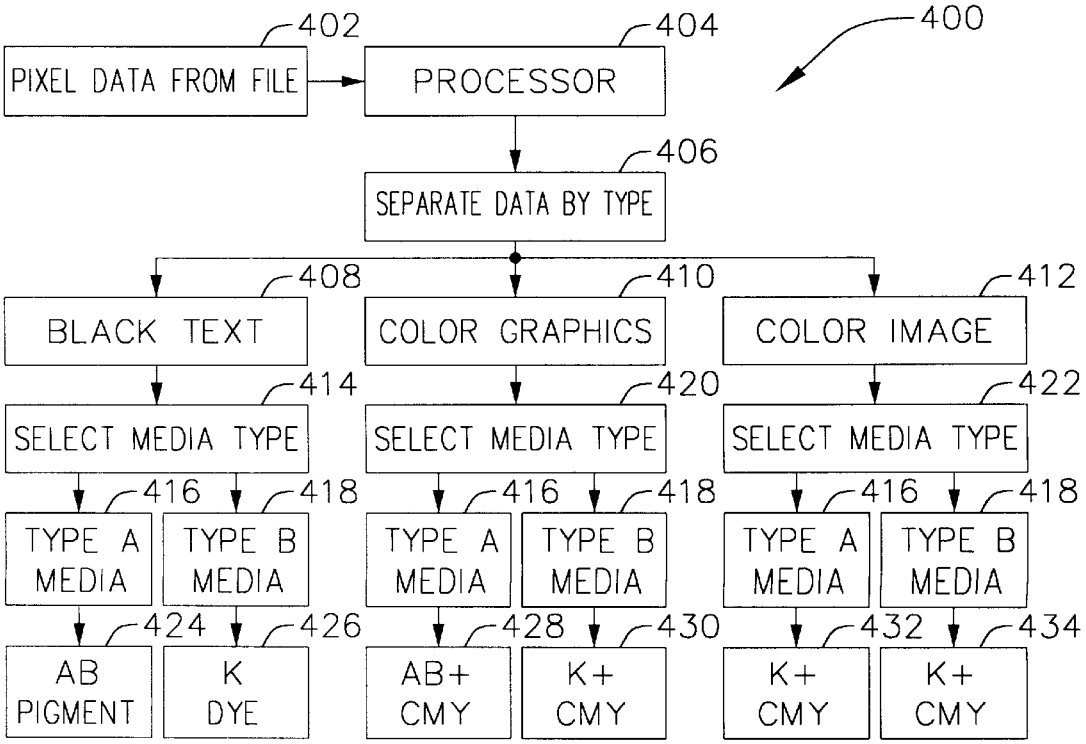
FIG. 4 is a flowchart illustrating an exemplary imaging pipeline according to the present invention.

A printing system for selectively printing with different types of ink according to an exemplary preferred embodiment of the present invention also includes a controller configured to generate ink dispenser control signals to selectively energize the ink dispensers. Referring to FIG. 4, an exemplary preferred imaging pipeline 400 is shown in the form of a flow diagram. After pixel data 402 are received by a processor at step 404, imaging pipeline processing can begin. Generally, the imaging pipeline makes decisions with respect to which inks to use and how, based on the media type, the nature of the print job (black text, color graphics, color image) and the level of print quality desired. At step 406, the imaging pipeline 400 evaluates the file data and separates the data by type (black text 408, color graphics 410 or color image 412). When the data type is black text, at step 414, the media type (Type A Media 416 or Type B Media 418) is selected. When the data type is color graphics, at step 420, the media type (Type A Media 416 or Type B Media 418) is selected. When the data type is color graphics, at step 422, the media type (Type A Media 416 or Type B Media 418) is selected. The media type can be selected automatically by the printer or manually, depending upon the printer.

Figure 5A:
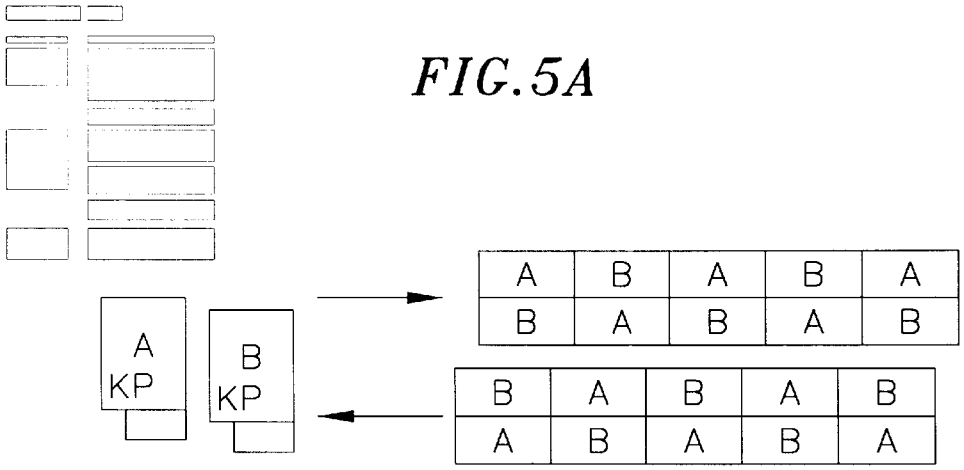
FIG. 5A illustrates an exemplary Black text only print mode according to the present invention.

When the data type is black text to be printed on Type A media, at step 424, the pipeline 400 controls generation of ink dispenser control signals to energize the pigment-based black ink dispensers (A, B) to print black text on the Type A media. In a preferred embodiment, the pipeline 400 controls generation of ink dispenser control signals to alternately energize the pigment-based black ink dispensers (A, B) as shown in the bi-directional text printing example (FIG. 5A). In an alternative embodiment, the pipeline 400 controls generation of ink dispenser control signals to energize the dye-based black ink dispenser (K) to print black text on the Type A media. When the data type is black text to be printed on Type B media, at step 426, the pipeline 400 controls generation of ink dispenser control signals to energize the dye-based black ink dispenser (K) to print text on the Type B media.

Figure 5B:
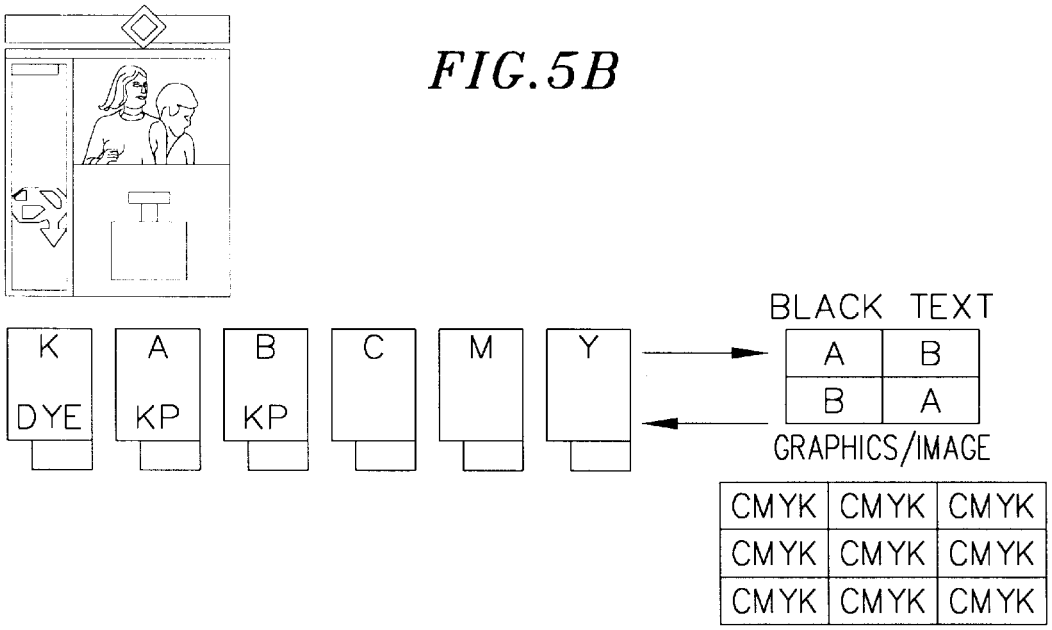
FIG. 5B illustrates an, exemplary mixed Text/graphics/Image print mode according to the present invention.

When the data type is color graphics to be printed on Type A media, at step 428, the pipeline 400 controls generation of ink dispenser control signals to energize the pigment-based black ink dispensers (A, B) to print black text and the cyan ink dispenser (C), the magenta ink dispenser (M) and/or the yellow ink dispenser (Y) to print graphics and/or an image on the Type A media. In an alternative embodiment, the pipeline 400 controls generation of ink dispenser control signals to energize the dye-based black ink dispenser (K) to print black text on the Type A media. When the data type is color graphics to be printed on Type B media, at step 430, the pipeline 400 controls generation of ink dispenser control signals to energize the dye-based black ink dispenser (K) to print black text and the dye-based cyan ink dispenser (C), the dye-based magenta ink dispenser (M) and/or the dye-based yellow ink dispenser (Y) to print graphics and/or an image on the Type B media. An example of color graphics data type printing is shown in FIG. 5B.

Figure 5C:
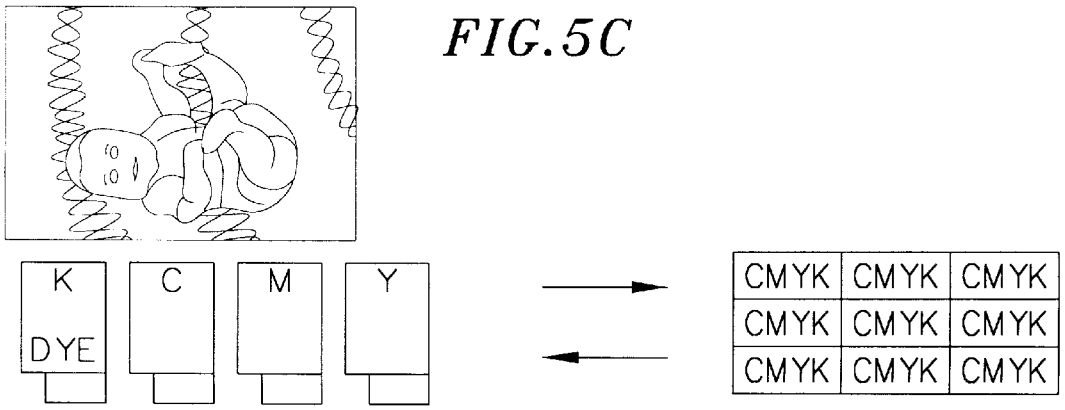
FIG. 5C illustrates a Color image print mode according to the present invention.

When the data type is a color image to be printed on Type A media, at step 432, the pipeline 400 controls generation of ink dispenser control signals to energize the dye-based black ink dispenser (K), the cyan ink dispenser (C), the magenta ink dispenser (M) and/or the yellow ink dispenser (Y) to print the color image on the Type A media. In an alternative embodiment, the pipeline 400 controls generation of ink dispenser control signals to energize the pigment-based black ink dispensers (A, B) instead of the dye-based black ink dispenser (K) to print the color image on the Type A media. When the data type is a color image to be printed on Type B media, at step 434, the pipeline 400 controls generation of ink dispenser control signals to energize the dye-based black ink dispenser (K), the cyan ink dispenser (C), the magenta ink dispenser (M) and/or the yellow ink dispenser (Y) to print the color image on the Type B media. An example of color image data type printing is shown in FIG. 5C.

The imaging pipeline can also take into account a desired print quality. By way of example, when printing on special media which does not accept pigmented inks, two choices are available. For Draft or Normal printing modes, the only inks used are CMY (for a narrower distal nozzle span) to increase throughput. For a Best printing mode, where throughput is not critical, the K and CMY print heads are used providing a true dye-based black for improved maximum density and efficient use of ink. In the Best printing mode, the use of ink is made more efficient by eliminating the use of composite black, and a higher quality output results from the higher density available with true black. This printing mode helps to alleviate problems with photo media ink capacity which effects (limits) the maximum density capability.

In one embodiment, processing and printing occurs on a swath-by-swath basis. However, with sufficient memory and processing power, a greater amount of data, e.g. for an entire page, can be processed and/or printed at the same time.

Figure 7:
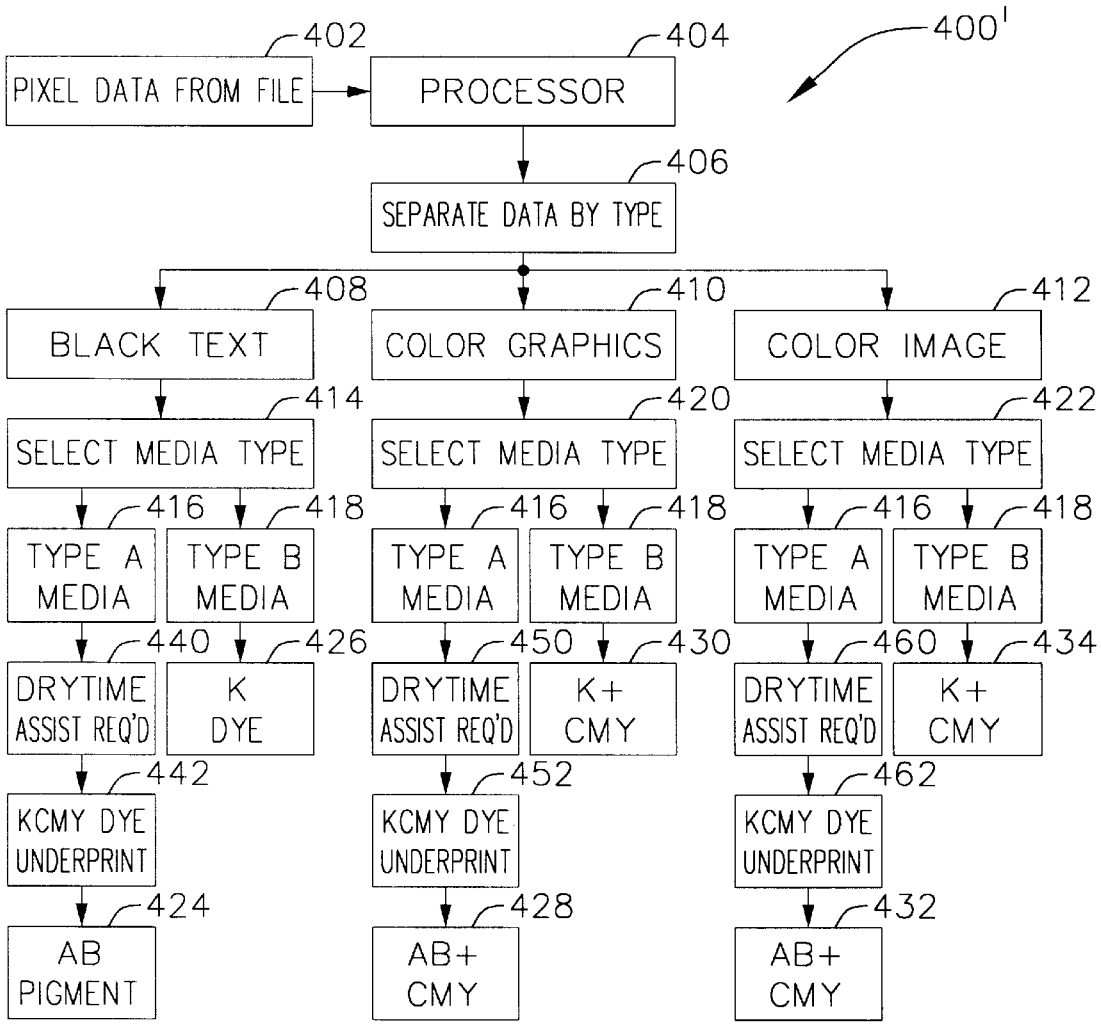
FIG. 7 is a flowchart illustrating an exemplary imaging pipeline with under/overprinting features according to the present invention.

FIG. 7 is a flowchart an alternative exemplary imaging pipeline 400' which includes under/overprinting features. Where like numerals are employed, the corresponding steps of the imaging pipelines 400 and 400' are the same and the description of these steps with reference to the imaging pipeline 400 is incorporated herein by reference. When the data type is black text to be printed on Type A media, at step 440, the pipeline 400 determines that daytime assistance is required or is to be employed at step 442. When the data type is color graphics to be printed on Type A media, at step 450, the pipeline 400 determines that daytime assistance is required or is to be employed at step 452. When the data type is a color image to be printed on Type A media, at step 460, the pipeline 400 determines that daytime assistance is required or is to be employed at step 462.

Figure 6A:
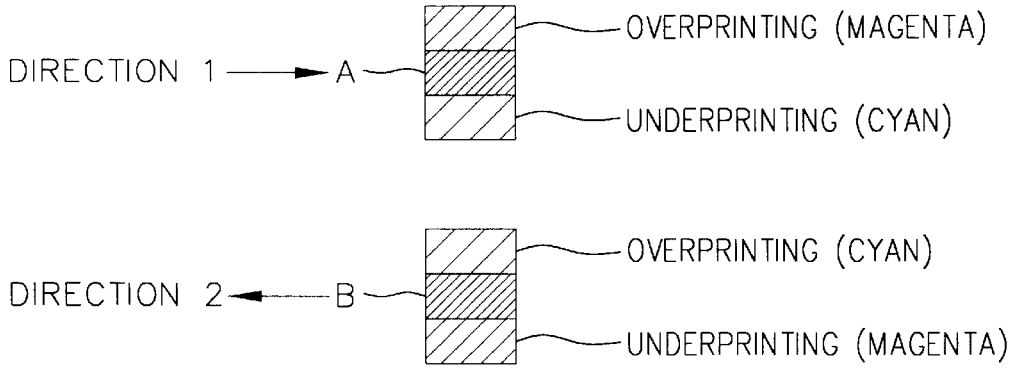
FIG. 6A PRIOR ART
FIG. 6A illustrates conventional bi-directional overprinting/overprinting.
Figure 6B:
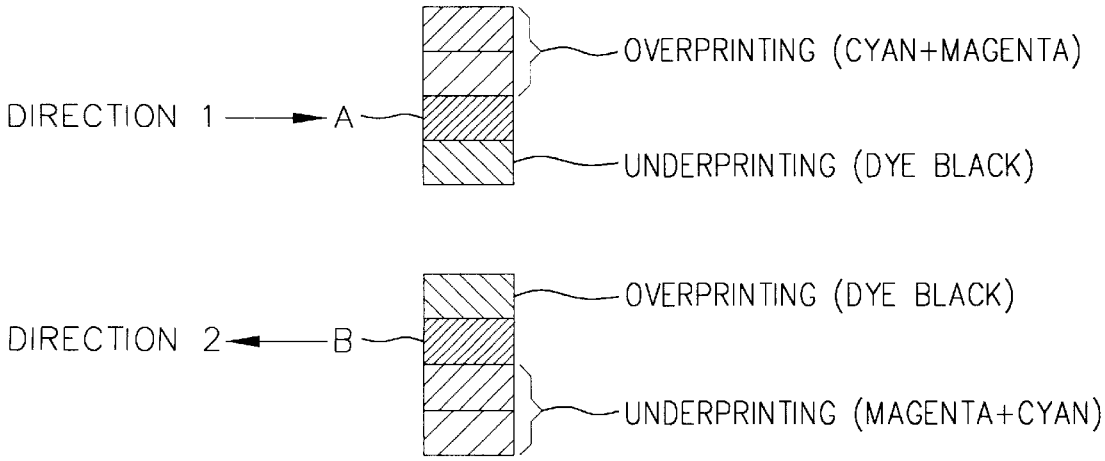
FIG. 6B illustrates exemplary bi-directional overprinting/overprinting according to the present invention.

A variety of different under printing and under/overprinting arrangements can be implemented with the printing system of the present invention. By way of example, FIG. 6B illustrates a bi-directional under/overprinting scheme where only the dye-based black ink dispenser (K), the cyan ink dispenser (C) and the magenta ink dispenser (M) are used to provide the under printing and overprinting layers. When the carriage scans from left-to-right (Direction 1), the dye-based black ink (K) is deposited on the item of media as the under printing layer, then the pigment-based black ink (A) is deposited, and then a composite of the cyan ink (C) and the magenta ink dispenser (M) is deposited as the overprinting layer. When the carriage scans in the right-to-left direction (Direction 2), a composite of the cyan ink (C) and the magenta ink dispenser (M) is deposited on the item of media as the under printing layer, then the pigment-based black ink (B) is deposited, and then the dye-based black ink (K) is deposited as the overprinting layer.

This scheme provides little or no hue shift in the black printing from one direction to another as compared to the prior CKMY print head arrangement. Thus, the location of the dye-based black ink (K) at the end of the ink dispenser sequence makes the printing system of the present invention particularly well suited for bi-directional printing. In an alternative embodiment, the composite layers are formed with CM and Y inks. The particular composition of these composites can be varied depending upon the type of media, the nature of the print job, the level of print quality desired and/or how much of each ink is left in the ink supplies.

Figure 8:
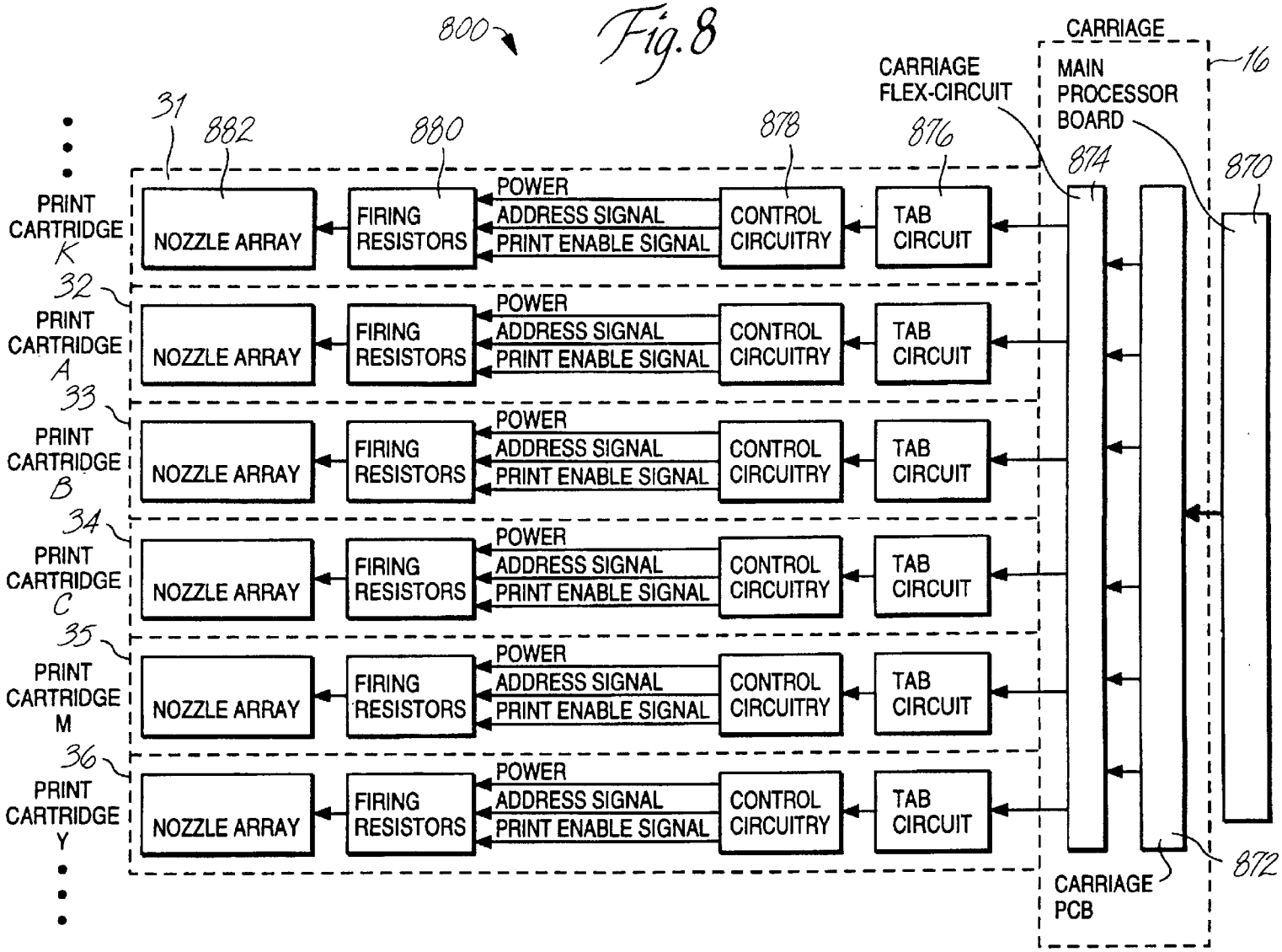
FIG. 8 illustrates electronics within the printer of FIG. 1 for generating energization signals for the fluid ejection elements in the print heads.

FIG. 8 illustrates exemplary circuitry 800 (in the printer 10, carriage assembly 16 and print cartridges 31–36) for generating firing signals for heater resistors in the print heads. A main processor board 870 in the printer performs the well known steps of decoding the print signals from a (personal) computer connected to an input of the printer and creating a bitmap of the dots to be printed in a swath buffer forming part of the main processor board 870. The data is transferred to a carriage printed circuit board (PCB) 872, which uses timing signals from the optical encoder strip 24 (FIG. 1) to generate the addressing signals for firing selected heater resistors in a particular print head. A carriage flex circuit 874 contains electrodes for being contacted by the contact pads on a print cartridge TAB circuit 876. A control circuit. 878 on the print head distributes the signals to the various heater resistor circuits. Heater (or firing) resistors 880 vaporize a portion of the ink in their associated chambers to expel a droplet of ink through an associated nozzle in a nozzle array 882.

Although the present invention has been described in terms of the preferred embodiment above, numerous modifications and/or additions to the above-described preferred embodiment would be readily apparent to one skilled in the art. It is intended that the scope of the present invention extends to all such modifications and/or additions.

We claim:

1. A printing system for selectively printing with different types of ink, the system comprising:

a plurality of ink dispensers including six ink dispensers arranged in a sequence, KABCMY,
K being a dye-based black ink dispenser,
A and B being pigment-based black ink dispensers,
C being a dye-based cyan ink dispenser,
M being a dye-based magenta ink dispenser, and
Y being a dye-based yellow ink dispenser; and a controller configured to generate ink dispenser control signals to selectively energize the ink dispensers.

2. The printing system of claim 1, wherein the controller is configured to generate the ink dispenser control signals to selectively energize the pigment-based black ink dispensers and the dye-based black ink dispenser depending upon the type of media being printed on.

3. The printing system of claim 1, wherein the controller is configured to generate the ink dispenser control signals to energize the dye-based black ink dispenser (K) to print text, graphics and/or an image.

4. The printing system of claim 1, wherein the controller is configured to generate the ink dispenser control signals to energize the pigment-based black ink dispensers (A, B) to print text, graphics and/or an image.

5. The printing system of claim 1, wherein the controller is configured to generate the ink dispenser control signals to alternately energize the so pigment-based black ink dispensers (A, B).

6. The printing system of claim 1, wherein the controller is configured to generate the ink dispenser control signals to energize the dye-based cyan ink dispenser (C), the dye-based magenta ink dispenser (M) and/or the dye-based yellow ink dispenser (Y) to print text, graphics and/or an image.

7. The printing system of claim 1, wherein the controller is configured to generate the ink dispenser control signals to energize the dye-based black ink dispenser (K) to under print.

8. The printing system of claim 1, wherein the controller is configured to generate the ink dispenser control signals to energize the dye-based cyan ink dispenser (C) and the dye-based magenta ink dispenser (M) to under print.

9. The printing system of claim 1, wherein the controller is configured to generate the ink dispenser control signals to energize the dye-based black ink dispenser-(K) to under print. and the dye-based cyan ink dispenser (C) and the dye-based magenta ink dispenser (M) to overprint, or vice versa.

10. A printing system for selectively printing with different types of ink, the system comprising:

a plurality of ink dispensers including a dye-based black ink dispenser (K), two pigment-based black ink dispensers (A, B) and a plurality of colored ink dispensers including a cyan ink dispenser (C) and a magenta ink dispenser (M); and a controller configured to generate ink dispenser control signals which energize the ink dispensers, the ink dispenser control signals being generated to selectively energize the dye-based black ink dispenser (K) and the pigment-based black ink dispensers (A, B) depending upon the type of media being printed on;

wherein the plurality of ink dispensers are arranged linearly such that the dye-based black ink dispenser (K) is positioned on one side of the pigment-based black ink dispensers (A, B) and the cyan ink dispenser (C) and the magenta ink dispenser (M) are positioned on another side of the pigment-based black ink dispensers (A, B).

11. The printing system of claim 10, wherein the pigment-based black ink dispensers (A, B) are positioned adjacent to each other.

12. The printing system of claim 10, wherein the controller is configured to generate the ink dispenser control signals to energize the dye-based black ink dispenser (K) to print text, graphics and/or an image.

13. The printing system of claim 10, wherein the controller is configured to generate the ink dispenser control signals to energize the pigment-based black ink dispensers (A, B) to print text, graphics and/or an image.

14. The printing system of claim 10, wherein the controller is configured to generate the ink dispenser control signals to alternately energize the pigment-based black ink dispensers (A, B).

15. The printing system of claim 10, wherein the controller is configured to generate the ink dispenser control signals to energize the colored ink dispensers to print text, graphics and/or an image.

16. The printing system of claim 10, wherein the controller is configured to generate the ink dispenser control signals to energize the dye-based black ink dispenser (K) to under print.

17. The printing system of claim 10, wherein the controller is configured to generate the ink dispenser control signals to energize the dye-based cyan ink dispenser (C) and the dye-based magenta ink dispenser (M) to under print.

18. The printing system of claim 10, wherein the controller is configured to generate the ink dispenser control signals to energize the dye-based black ink dispenser (K) to under print and the dye-based cyan ink dispenser (C) and the dye-based magenta ink dispenser (M) to overprint, or vice versa.

* * * * *

UNITED STATES PATENT AND TRADEMARK OFFICE

CERTIFICATE OF CORRECTION

PATENT NO. : 6,467,896 B2
DATED : October 22, 2002
INVENTOR(S) : Meyer et al.

It is certified that error appears in the above-identified patent and that said Letters Patent is hereby corrected as shown below:

Column 3,
Line 45, delete “an,” and insert therefor -- an --.

Column 8,
Line 5, delete “circuit.” and insert therefor -- circuit --.
Line 62, delete “print.” and insert therefor -- print --.

Signed and Sealed this

Ninth Day of March, 2004

JON W. DUDAS
*Acting Director of the United States Patent and Trademark Office*